US006957756B2

(12) United States Patent
Lat et al.

(10) Patent No.: US 6,957,756 B2
(45) Date of Patent: Oct. 25, 2005

(54) TOOL WITH NOSEPIECE FOR BENDING FASTENER UPON INSTALLATION AND FASTENER THEREFOR

(75) Inventors: Geronimo E. Lat, Ivanhoe, IL (US); Thomas V. Fasano, Buffalo Grove, IL (US); Garry F. Tupek, Naperville, IL (US)

(73) Assignee: Illinois Tool Works Inc., Glenview, IL (US)

( * ) Notice: Subject to any disclaimer, the term of this patent is extended or adjusted under 35 U.S.C. 154(b) by 77 days.

(21) Appl. No.: 10/119,597

(22) Filed: Apr. 10, 2002

(65) Prior Publication Data

US 2003/0192935 A1 Oct. 16, 2003

(51) Int. Cl.[7] ..... B25C 5/02
(52) U.S. Cl. ..... 227/83; 227/88; 227/123
(58) Field of Search ..... 227/83, 82, 88, 227/123, 95, 127; 412/43, 34; 411/439, 447, 485

(56) References Cited

U.S. PATENT DOCUMENTS

| | | | | |
|---|---|---|---|---|
| 506,861 A | | 10/1893 | Prentice | |
| 770,479 A | | 9/1904 | Shuster | |
| 2,741,147 A | | 4/1956 | Marano | |
| 2,748,645 A | * | 6/1956 | Peckham et al. | 411/548 |
| 2,906,547 A | | 9/1959 | Bortner | |
| 3,443,298 A | * | 5/1969 | Romeo | 227/83 |
| 3,527,477 A | * | 9/1970 | Langwell | 281/27.2 |
| 3,690,147 A | | 6/1976 | Murray | |
| 4,489,875 A | * | 12/1984 | Crawford et al. | 227/19 |
| 4,691,427 A | | 9/1987 | Hill | |
| 4,719,917 A | * | 1/1988 | Barrows et al. | 606/220 |
| 5,366,479 A | * | 11/1994 | McGarry et al. | 606/219 |
| 5,715,987 A | * | 2/1998 | Kelley et al. | 227/175.1 |
| 5,725,554 A | | 3/1998 | Simon et al. | |
| 6,113,332 A | | 9/2000 | Hill | |
| 6,193,126 B1 | * | 2/2001 | Lee | 227/83 |

FOREIGN PATENT DOCUMENTS

EP 0 955 011 10/1999

* cited by examiner

*Primary Examiner*—Scott A. Smith
*Assistant Examiner*—Gloria R. Weeks
(74) *Attorney, Agent, or Firm*—Lisa M. Soltis; Mark W. Croll; Donald J. Breh

(57) ABSTRACT

A fastener driving tool having a reciprocating driver blade and a nosepiece, and being configured for sequentially feeding fasteners to the nosepiece for engagement by the driver blade for subsequent driving into a workpiece, each fastener defining a plane, further includes a deformation formation in the nosepiece configured for engaging a portion of each of the fasteners so that upon impact of the fastener by the driver blade, the engaged fastener portion is deformed in a direction transverse to the plane to define a deformed portion, the deformed portion configured for providing a clamping force upon at least one of the workpiece and a workpiece material being secured to the workpiece. A fastener is provided for use in such a tool and includes a crown configured so that, upon impact with at least one of the workpiece and the workpiece material, the crown has a nonlinear configuration.

13 Claims, 7 Drawing Sheets

TOOL WITH NOSEPIECE FOR BENDING FASTENER UPON INSTALLATION AND FASTENER THEREFOR

BACKGROUND OF THE INVENTION

The present invention relates generally to fastener driving tools used for driving fasteners into workpieces to secure materials to the workpieces (referred to as workpiece materials), and specifically to fastener driving tools configured for driving two-legged fasteners, one example of such being referred to as a staple.

Conventional fastener driving tools feature a reciprocating driver blade which impacts a fastener fed to a nosepiece by a magazine. Whether powered pneumatically, manually, by combustion or electricity, such tools provide sufficient force to the driver blade that it separates the fastener from adjacent fasteners in the magazine, and drives the fastener so that the fastener is sufficiently embedded in the workpiece.

Commercially available two-legged fasteners include a pair of separated, generally parallel legs separated by a crown to form an inverted "U"-shape. Such fasteners are typically used in the installation of workpiece materials such as asphalt roofing shingles, building siding, wallboard, Romex® wire, Nomex® wire, Tyvek® insulation wrap, other insulation felts and other similar applications. One operational problem of two-legged fasteners is that the legs are sometimes driven too deeply into the workpiece, causing the crown to pierce the surface of the workpiece material. When this happens, the workpiece material is not as securely held. In other words, the amount of force needed to pull the workpiece material away from the workpiece ("pull through") decreases when the workpiece material has been pierced. A side effect of this piercing is that the workpiece material may be damaged.

Another drawback of currently available two-legged fasteners has resulted in an effort to increase the clamping force provided. In some cases, workpiece material secured to a substrate by two-legged fasteners can become detached if the material is exposed to certain forces, including high winds.

Still another design consideration of such two-legged fasteners is that if relatively delicate workpiece materials are intended for installation, including the cable or wire products described above, the crown portion of the fastener may damage the cable or other material.

BRIEF SUMMARY OF THE INVENTION

The above-identified design considerations are addressed by providing a fastener driving tool configured for driving a fastener so that, upon impact with the workpiece or substrate, the fastener has a nonlinear shape projecting transversely to a plane of the fastener for providing increased clamping force. Another advantage of the nonlinear fastener shape described above is the resistance to penetrating the workpiece material. The tool drives the fastener by impacting the crown near the leg portion without contacting the clamping portion of the fastener crown.

More specifically, a fastener driving tool is provided having a reciprocating driver blade and a nosepiece, and being configured for sequentially feeding fasteners to the nosepiece for engagement by the driver blade for subsequent driving into a workpiece. Each of the fasteners defines a plane. The tool further includes a deformation formation in the nosepiece configured for engaging a portion of each of the fasteners, so that upon impact of the fastener by the driver blade, the engaged fastener portion is deformed in a direction transverse to the plane to attain a deformed condition. The deformed condition of the deformation portion of the fastener is configured for providing a clamping force upon workpiece material secured to the workpiece.

Also provided is a fastener for use in such a tool having a reciprocating driver blade and a nosepiece with a deformation formation, the tool being configured for sequentially feeding the fasteners to the nosepiece for engagement by the driver blade and impacting upon the deformation formation for subsequent driving into a workpiece and deformation. The fastener includes a pair of legs each having a lower end configured for entering a workpiece, and a crown disposed between and joining the legs and being configured so that, upon impact with the deformation formation with workpiece material secured to the workpiece, the crown has a nonlinear configuration and includes a portion which projects from a plane defined by legs.

DETAILED DESCRIPTION OF THE INVENTION

Figure 1:
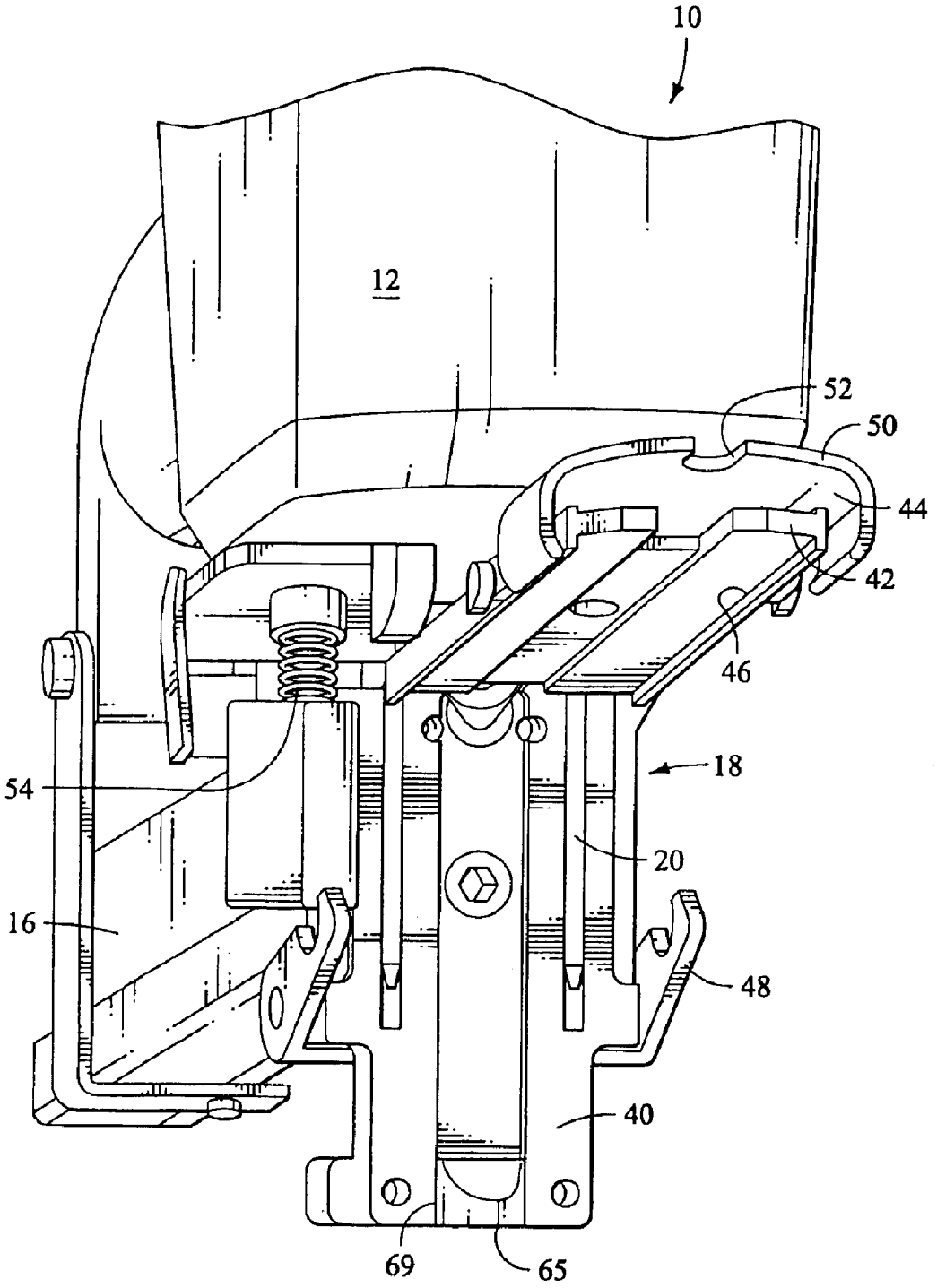
FIG. 1 is a fragmentary front perspective view of a fastener driving tool featuring the present deformation formation.
Figure 2:
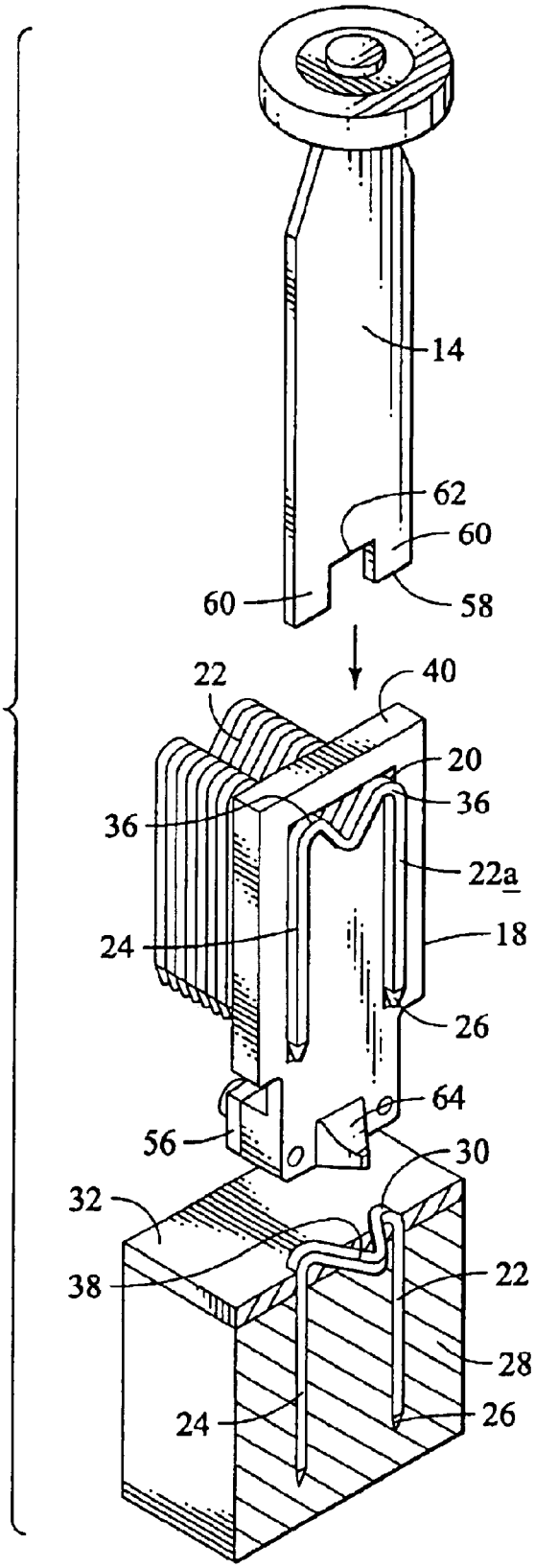
FIG. 2 is a fragmentary exploded view of the operation of the driver blade of the present tool upon the present fastener which is being driven into a workpiece.

Referring now to FIGS. 1 and 2, a fastener driving tool suitable for use with the present invention is generally designated 10 and includes a housing 12 enclosing a reciprocating driver blade 14, and a magazine 16 configured for providing a sequence of fasteners for driving. The tool 10 may be pneumatic, combustion-powered, manual, electrically-powered or powder activated, and a variety of such configurations of such tools are known in the art. Examples of such tools are sold under the trademark PASLODE® by Illinois Tool Works, Inc., the present assignee. A nosepiece 18 receives fasteners through a fastener opening 20, and is configured for positioning a next-to-be-driven fastener 22*a* for engagement by the descending driver blade 14.

Figure 3:
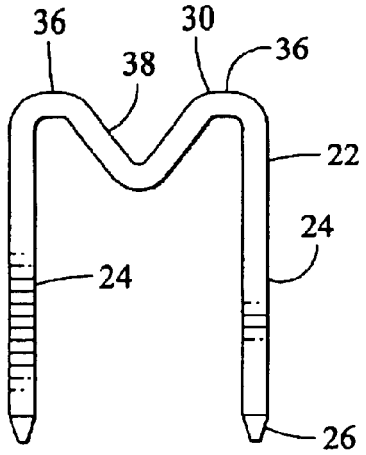
FIG. 3 is a front elevational view of the present fastener.
Figure 4:
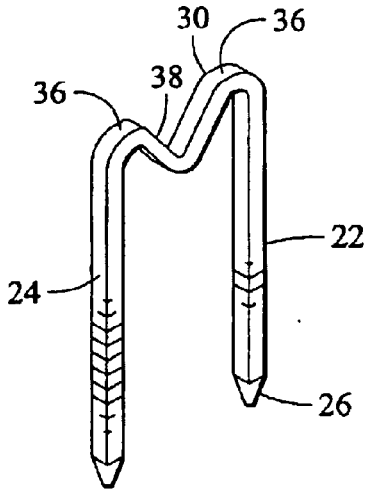
FIG. 4 is a top perspective view of the present fastener prior to being driven.

Referring now to FIGS. 2–4, the fastener preferred for use in the tool 10 is a two-legged fastener 22, in some cases known as a staple, having two legs 24, each leg having a point 26 shaped to pierce and become embedded in a workpiece 28 and joined together by a crown 30. In conventional staples, the crown is generally linear or straight, and the fastener forms an inverted "U"-shape. In an effort to increase the utility of two-legged fasteners, the present fastener 22 is provided with a crown 30 that is less likely to pierce or damage workpiece material 32 which is to be attached to the workpiece 28, and also which has relatively greater clamping force over the workpiece material 32 than standard inverted "U"-shaped fasteners. For the purposes of this discussion, the workpiece material 32 is intended to be attached to the workpiece or substrate 28, and the fastener legs 24 are configured, depending on the type of material, to either penetrate or avoid the material 32 and penetrate the substrate, while the crown 30 typically is designed to hold the material against the substrate.

Figure 5:
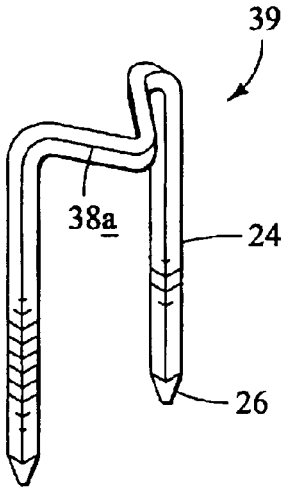
FIG. 5 is a top perspective view of an alternate embodiment of the present fastener.
Figure 9:
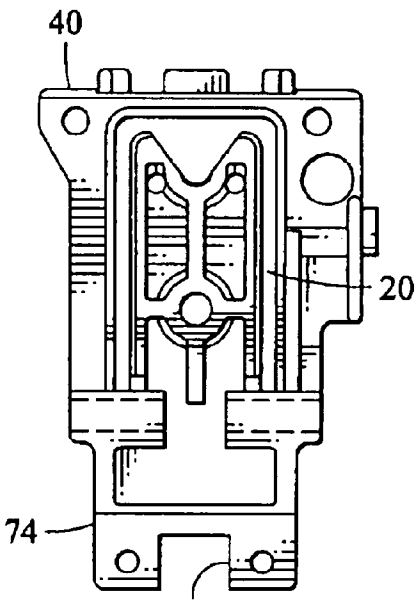
FIG. 9 is a rear elevational view thereof.
Figure 8:
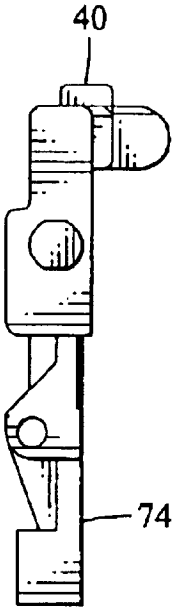
FIG. 8 is a side elevational view thereof.
Figure 7:
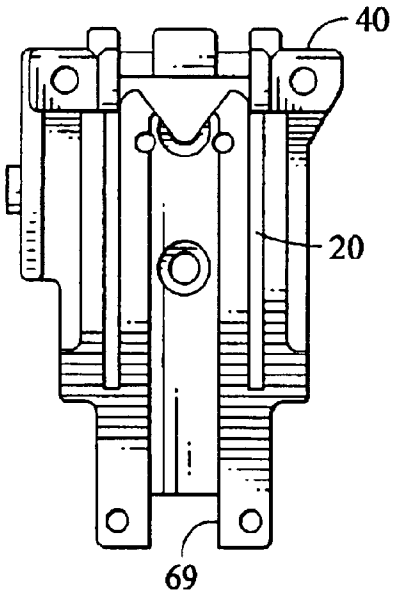
FIG. 7 is a front elevational view of the back plate of FIG. 6.
Figure 6:
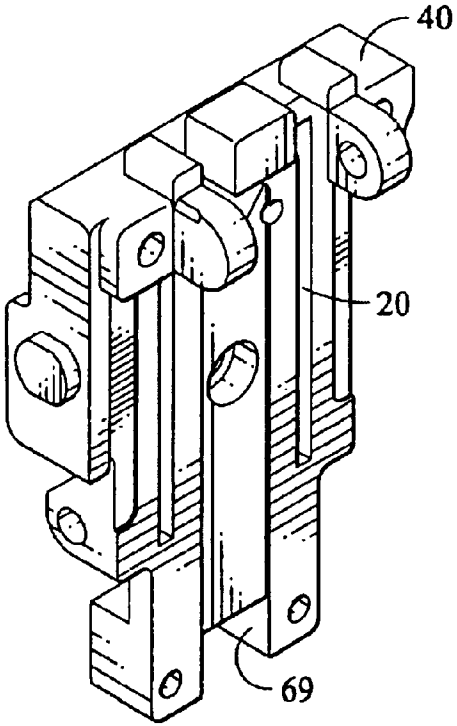
FIG. 6 is a top perspective view of a nosepiece back plate of the present tool.

The present crown 30 includes a pair of shoulders 36 separated by a deformation portion 38. While it is contemplated that the deformation portion 38 may have a variety of shapes, as is discussed below, it is preferred that the portion defines a general "V" configuration which depends from the shoulders 36 and is generally coplanar with the fastener 22. As an alternative, and referring to FIG. 5, it is also contemplated that a fastener 39 may be provided to the tool 10 in a format in which, prior to driving, the deformation portion 38*a* projects at an angle to the plane of the fastener. As will be seen below, the deformation portion 38 provides enhanced clamping force over conventional staples, and, at the same time, reduces the possibility that the workpiece material 32 will be pierced or otherwise damaged in the fastener driving operation.

Referring again to FIGS. 1, 2, 6–9 and 13–16, the present nosepiece 18 includes a back plate 40, a front plate 42 and a workpiece contact element 44. The nosepiece 18 is preferably configured so that the front plate 42 is pivotably mounted to the back plate 40 so that the front plate may be displaced from the back plate to remove jammed fasteners or to make other necessary adjustments. In addition, the back and front plates 40, 42 combine to form a driver blade passageway 46 when they are held together in an operational position (best seen in FIGS. 13–16) by a latch mechanism 48. The fastener opening 20 is located in the back plate 40 and permits the sequential passage of fasteners 22 from the magazine 16.

As is typical in such tools 10, the workpiece contact element 44 (best seen in FIG. 1) is slidably mounted to the front plate 42 to trigger operational pre-firing or pre-driving sequences as is well known in the art. Prior to driving the fastener 22, the tool 10 is pressed against the workpiece 28 so that the workpiece contact element 44 is depressed and moves (usually upward) relative to the front plate 42. While the tool 10 will be described in a normal operational position relative to the workpiece 28 as shown in FIG. 1, with the tool above the workpiece, it is also contemplated that the present tool may be operated in an inverted position over the user's head for ceiling work or other overhead work, as well as other orientations known to skilled operators in the art. In the preferred embodiment, a leading edge 50 of the workpiece contact element has a notch 52.

Also, in some applications, the tool 10 may be equipped with a depth of drive adjustment 54 which allows the user to change the depth the fastener 22 is driven into the workpiece 28 or to adjust for variable fastener lengths, as is known in the art.

Figure 11:
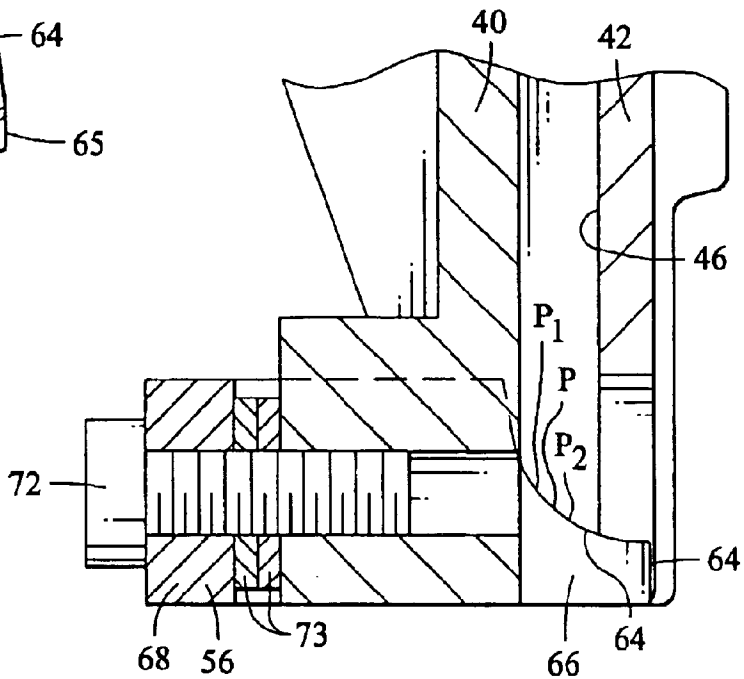
FIG. 11 is a fragmentary vertical cross-section of the deformation formation in the nosepiece.
Figure 10:
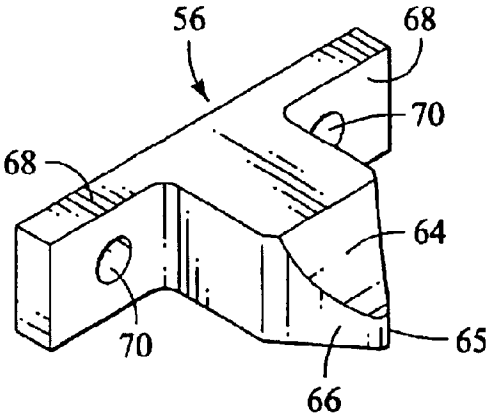
FIG. 10 is a top perspective view of the present deformation formation.

Referring now to FIGS. 2, 10 and 11, an important feature of the present tool 10 is that the nosepiece 18 is provided with a deformation formation 56 configured to receive the fastener 22, deform the deformation portion 38 and thus protect the workpiece material 32 from penetration by the crown 30. Another function of the present deformation formation 56 is to provide additional clamping force by the fastener 22 upon the workpiece material 32 which is enhanced over conventional "U"-shaped staple-type fasteners. The latter function is provided by deforming the deformation portion 38, or providing a pre-deformed deformation portion 38*a*, so that it has an increased "footprint", or covers a relatively large area of the workpiece material 32, compared to conventional staples. Still another feature of the present tool is that the clamping force provided by the fastener 22 is independent of the depth to which the fastener legs 24 have been driven into the workpiece 28.

Figure 13:
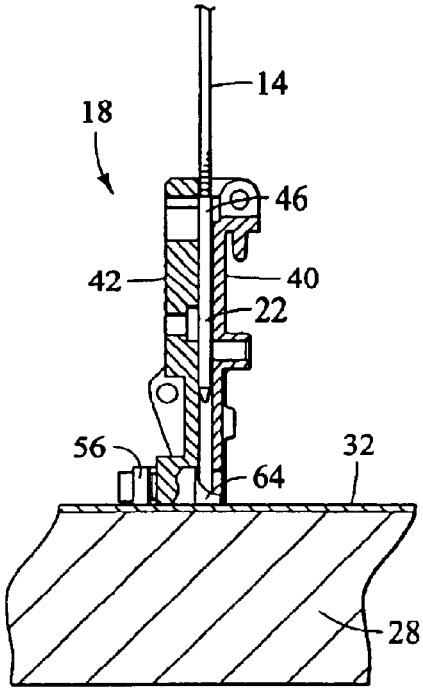
FIGS. 13–16 are vertical cross-sections of the present nosepiece in a fastener-driving sequence.
Figure 14:
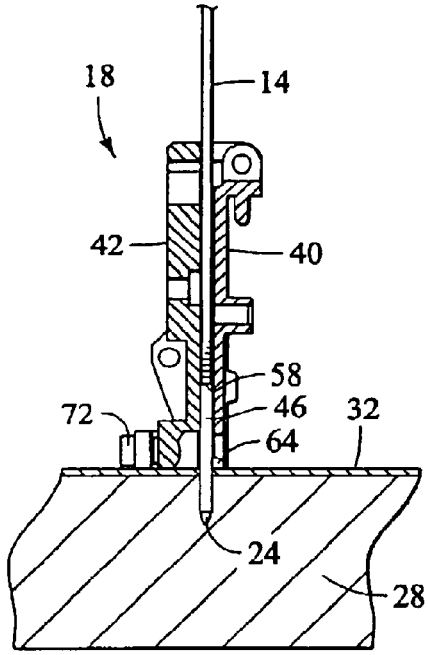
Figure 15:
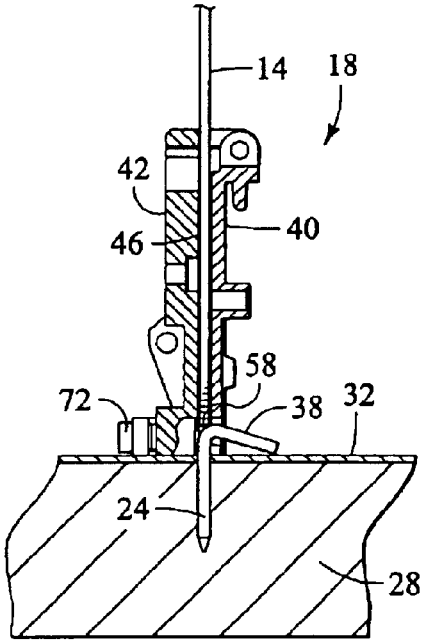
Figure 16:
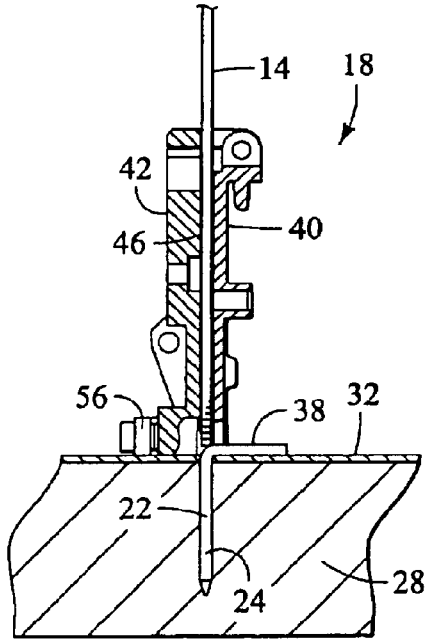

Referring now to FIGS. 13–16, which depict a sequential operational cycle of the driving of a single fastener, in the preferred embodiment, prior to driving, the fastener 22 defines a plane (FIG. 13). Upon impact of the fastener 22 by the driver blade 14, the deformation portion 38 of the crown 30 is deformed in a direction which projects from the fastener plane. In the depicted embodiment, the projection is generally transverse to the fastener plane, and at the conclusion of the deformation process, the crown 30 attains a deformed condition. It is contemplated that the amount of transverse angular deformation relative to the plane may vary to suit the application, and deformations in the range of 30°–120° are contemplated.

Referring now to FIGS. 2 and 13–16, the deformed condition of the deformation portion 38 is achieved through interaction of the fastener 22 and the nosepiece 18 of the tool. More specifically, the driver blade 14 is provided with a lower impact edge 58 having two tabs 60 separated by a notch or recess 62. The recess 62 is dimensioned for accommodating the deformation formation 56. Once the tool 10 is fired, initiating the fastener driving operation, the driver blade 14 is propelled down the driver blade passageway 46. Along the way, the tabs 60 impact corresponding shoulders 36 of the next-to-be-driven fastener 22*a*, separating it from the remaining fasteners in the magazine 16 and driving the fastener 22*a* towards the deformation formation 56, and ultimately, the workpiece 28, securing the workpiece material 32 thereto.

During the driving operation, the fastener legs 24 pass the deformation formation 56 on either side, and enter the workpiece 28. The configuration of the fastener 22 is such that the legs 24 are substantially embedded in the workpiece material 32 and the workpiece 28 before the crown 30 engages the deformation formation 56. At the formation 56, the crown 30 engages a ramp portion 64 which deforms the deformation portion 38, forcing it to project from, and preferably transversely out of the plane of, the fastener 22.

While the driver blade 14 does not directly engage the deformation portion 38, the driving force applied to the shoulders 36, and the sloping, arcuate, radiused or inclined shape of the ramped portion 64 cause the deformation portion to attain the deformed condition shown in FIGS. 2, 12, 16 and 17.

The driver blade 14 is prevented from driving the fastener 22 further into the substrate 28 by one or more of the interaction of the tab 60, the shoulders 36 and the substrate, the engagement between the recess 62 and the deformation formation 56, and the depth of drive mechanism 54. It will be appreciated that the notch 52 in the workpiece contact element 44 is configured for also accommodating the deformation formation 56.

It will be seen that the deformed condition provides increased clamping force in the form of a larger footprint on the workpiece material 32 compared to standard, linear crown staples, while avoiding the potential for the crown 30 to pierce the material. It will also be seen that the ramp portion 64 forms a wedge-like shape or point 65 which contributes to the shape attained by the deformation portion 38 upon impact with the substrate material 32.

Referring now to FIGS. 2, 10 and 11, in addition to the ramp portion 64, the deformation formation 56 includes a toe portion 66 located beneath the ramp portion which actually contacts the workpiece 28 or workpiece material 32 in most applications. The height of the toe portion 66 may vary to suit the application, depending on the type of material 32 being secured to the substrate 34. The height of the toe portion 66 relative to the geometry of the ramp portion 64 may be varied to adjust the amount of clamping force applied by the fastener 22. To secure the formation 56 to the nosepiece 18, the formation includes at least one fastening structure 68 extending laterally from the formation. As shown in FIG. 10, the formation 56 has a general "T" shape when viewed from above. The nosepiece includes a notch 69 in at least one of the back plate 40 and the front plate 42 for accommodating the deformation formation 56. The orientation of the ramp portion 64 and the formation 56 in general may change depending on whether it is attached to the back plate 40 or the front plate 42.

Each fastening structure 68 has at least one fastening formation 70 for securing the formation 56 to one of the back plate 40 and the front plate 42. In the preferred embodiment, the formation 56 is secured to the back plate 40, and the fastening formation 70 is an eyelet dimensioned for receiving a fastener 72 which also engages the back plate. However, it is contemplated that the specific fastening technology may vary depending on the particular application.

Another feature of the present tool 10 is that the deformation formation 56 may be adjusted laterally relative to the nosepiece to vary a point "P" on the ramped portion 64 where the driver blade 14 intersects (FIG. 11). In this manner, the degree of deformation of the deformation portion 38 may be varied. Thus, deformation at a point $P_1$ will be greater than at a point $P_2$. Accordingly, one or more spacers 73 may be disposed or removed between the fastening structure 68 and a rear surface 74 of the back plate 40 to adjust the lateral disposition of the ramp formation 64 relative to the driver blade passageway 46. While in the above description, the deformation formation 56 is releasably attached to the nosepiece 18, it is also contemplated that the formation may be integrally secured thereto.

Figure 18:
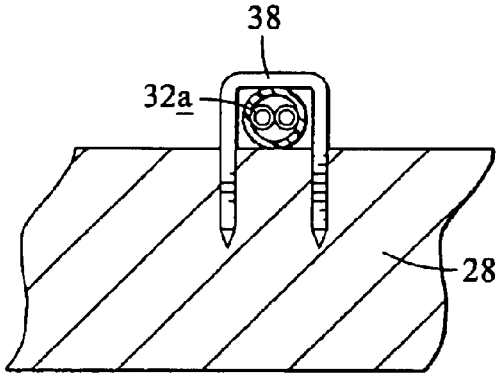
FIG. 18 is a fragmentary cross-section of a workpiece including a cable attached to a substrate.
Figure 19:
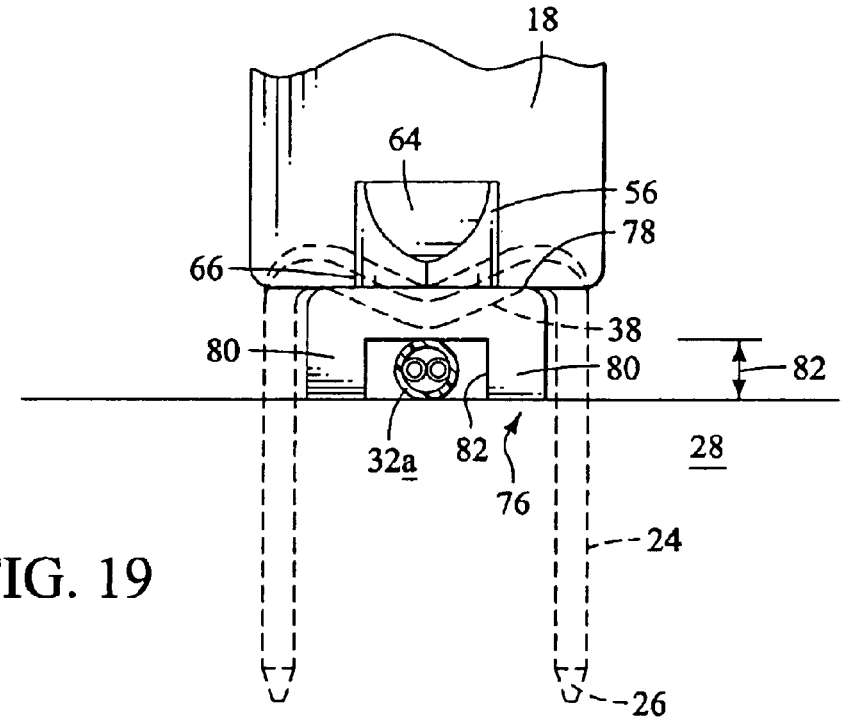
FIG. 19 is a fragmentary front elevational view of the present tool driving the present fastener with an optional standoff fitting.

Referring now to FIGS. 18 and 19, in applications where the workpiece material 32 is relatively fragile, as for example where the material is wire or cable, it is important that the fastener crown 30 not pierce the material. To this end, the nosepiece 18 is optionally provided with a guide 76 which is configured for limiting the penetration of the driver blade 14 into the workpiece, and thus creating a standoff of the crown away from the substrate 28 a sufficient distance to prevent the crown from piercing the workpiece material 32. By the same token, the deformation portion 38 still exerts sufficient clamping force on the workpiece material 32 that the cable or wire is held in place (best seen in FIG. 18). Another function of the guide 76 is to protect the workpiece material 32 from unwanted contact or damage caused by the fastener legs 24.

More specifically, the guide 76 is preferably secured to a bottom of the nosepiece 18 by suitable releasable fasteners, by chemical adhesives or by welding, depending on the application. Included on the guide 76 is an upper-most support surface 78 which engages the nosepiece 18, and at least one and preferably two depending legs 80 which together define a distance or separation space 82 between the workpiece 28 and the nosepiece 18 sufficient to accommodate the workpiece material 32. Also, the legs 80 are preferably spaced apart sufficiently to accommodate the workpiece material 32*a* therebetween. The legs 80 thus protect the workpiece material 32*a* from damage or unwanted contact with the fastener legs 24. In the preferred embodiment, the guide 76 defines a generally inverted "U"-shape, however other shapes are contemplated depending on the application, provided sufficient separation space 82 is defined.

The support surface 78 receives the impact of the driver blade 14 through contact with the tabs 60 to prevent further penetration of the legs 24 into the workpiece 28. At the same time, upon impact of the driver blade 14 with the fastener 22 and the engagement with the deformation formation 56, the deformation portion 38 is manipulated to project from the plane of the fastener 22 to provide a clamping force upon the wire or cable 32.

Figure 12:
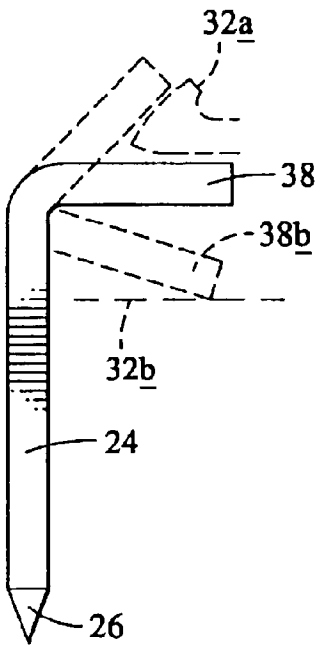
FIG. 12 is a schematic side view of the present fastener shown in various operational positions.
Figure 17:
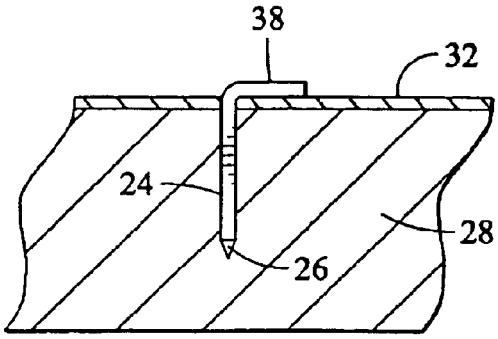
FIG. 17 is a fragmentary cross-section of a workpiece having the present fastener driven therein.

Referring now to FIGS. 12, 17 and 18, while it is preferred that the deformation portion 38 be deformed so that a maximum surface area or footprint is contacting the workpiece material 32 (best seen in FIG. 17), it is contemplated that increased clamping force is still obtained when the angular displacement is greater or less than 90°. It will be seen in FIGS. 12 and 18 that a material 32*a* is still sufficiently engaged by the deformation portion 38 to clamp it to the substrate 28, even though the angular displacement is greater than 90°. Conversely, in applications where the driver blade does not drive the legs 24 as far into the substrate 28, the deformation may be less than 90°, as seen in the case of the substrate 32*b* and the deformation portion 38*b* (FIGS. 12 and 19). Since the fastener driving force is applied by the driver blade 14 to the shoulders 36, the amount of angular deformation of the deformation portion 38 from the plane of the fastener 22 is determined in part by the configuration of the workpiece material 32 itself, in combination with the configuration of the deformation formation 56. However, the amount of deformation is independent of the force provided to the shoulders 36.

Figure 20:
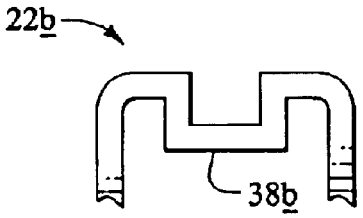
FIG. 20 is a fragmentary front elevational view of an alternate embodiment to the present fastener.
Figure 21:
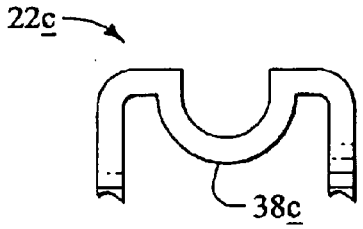
FIG. 21 is a fragmentary front elevational view of a second alternate embodiment of the present fastener.
Figure 22:
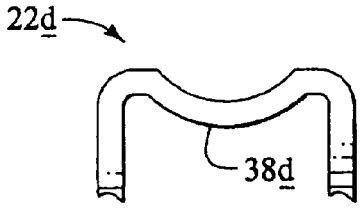
FIG. 22 is a fragmentary front elevational view of a third alternate embodiment of the present fastener.

Referring now to FIGS. 20–22, it is contemplated that the fastener 22 may be provided in a variety of configurations in which the deformation portion 38 assumes different shapes while still being able to provide increased clamping force upon the workpiece material 32. In fact, it has been found that the deformation portion 38, which in the deformed condition projects at an angle transverse to the plane of the fastener 22 as described above, requires approximately 35–50% increased pullout force than conventional flat-crowned staples.

While the preferred configuration of the deformation portion 38 is "V"-shaped, it is contemplated that in an alternate fastener 22*b* a deformation portion 38*b* may be "U"-shaped and generally symmetrically positioned on the crown 30, as seen in FIG. 20. Alternatively, referring to FIG. 21, an alternate fastener 22*c* is shown having a deformation portion 38*c* which is more free-form and is non-symmetrical on the crown 30. A further alternative is shown in FIG. 22, in which a fastener 22*d* has a radiused or arcuate deformation portion 38*d*.

While specific embodiments of the tool with a nosepiece for bending a fastener upon installation and fastener therefor of the present invention have been shown and described, it will be appreciated by those skilled in the art that changes and modifications may be made thereto without departing from the invention in its broader aspects and as set forth in the following claims.

What is claimed is:

1. A fastener driving tool having a reciprocating driver blade and a nosepiece, said tool being configured for sequentially feeding fasteners to said nosepiece for engagement by said driver blade for subsequent driving into a workpiece, each fastener defining a plane, said tool comprising:

a deformation formation in said nosepiece configured for engaging a portion of each fastener so that upon impact of the fastener by said driver blade, the fastener is driven into the workpiece and, through momentum of the driver blade, the engaged fastener portion is deformed by impact of the fastener portion upon said deformation formation in a direction transverse to said plane to attain a deformed condition configured for providing a clamping force upon a workpiece material being secured to the workpiece;

wherein said driver blade has an impact edge with a recessed portion configured for accommodating said deformation formation.

2. The tool of claim 1 wherein said nosepiece has a front plate and a back plate, and said deformation formation is provided on at least one of said front plate and said back plate.

3. The tool of claim 2 wherein said deformation formation is removably secured to said nosepiece.

4. The tool of claim 1 wherein the fastener has two legs separated by a crown and said driver blade is provided with said impact edge defined by two tabs separated by a recessed portion, said tabs each disposed to provide an impact to a corresponding one of said legs.

5. The tool of claim 4 wherein the fastener crown is divided into adjacent shoulder portions separated by the deformed portion, and said tabs are each dimensioned to engage a corresponding shoulder portion.

6. A fastener driving tool having a reciprocating drive blade and a nosepiece, said tool being configured for sequentially feeding fasteners to said nosepiece for engagement by said driver blade for subsequent driving into a workpiece, each fastener defining a plane, said tool comprising:

a deformation formation in said nosepiece configured for engaging a portion of each fastener so that upon impact of the fastener by said driver blade, the fastener is driven into the workpiece and, through momentum of the driver blade, the engaged fastener portion is deformed by impact of the fastener portion upon said deformation formation in a direction transverse to said plane to attain a deformed condition configured for providing a clamping force upon a workpiece material being secured to the workpiece;

wherein said deformation formation has a toe portion with a lower surface for contacting one of the workpiece and the workpiece material, and a ramp portion for receiving and deforming the fastener portion;

wherein said deformation formation is laterally adjustable on said nosepiece so that said driver blade is alignable with different selected locations on said ramp portion.

7. The tool of claim 6 wherein said ramp portion has a configuration taken from the group comprising arcuate, radiused and inclined.

8. A fastener driving tool having a reciprocating driver blade and a nosepiece, said tool being configured for sequentially feeding fasteners to said nosepiece for engagement by said driver blade for subsequent driving into a workpiece, each fastener defining a plane, said tool comprising:

a deformation formation in said nosepiece configured for engaging a portion of each fastener so that upon impact of the fastener by said driver blade, the fastener is driven into the workpiece and, through momentum of the driver blade, the engaged fastener portion is deformed by impact of the fastener portion upon said deformation formation in a direction transverse to said plane to attain a deformed condition configured for providing clamping force upon a workpiece material being secured to the workpiece;

a guide associated with said nosepiece for limiting the penetration of the fastener into the workpiece and for protecting the workpiece material from the fastener.

9. The tool of claim 8 wherein said guide is a standoff secured to a lower end of said nosepiece for defining a separation space between said nosepiece and at least one of the workpiece and the workpiece material.

10. A fastener driving tool having a reciprocating driver blade and a nosepiece, said tool being configured for sequentially feeding fasteners to said nosepiece for engagement by said driver blade for subsequent driving into a workpiece, each fastener having a pair of legs separated by a crown and defining a plane, the crown including a pair of shoulders separated by a deformation portion, said tool comprising:

said driver blade having an impact edge with at least one tab constructed and arranged for impacting a corresponding shoulder for driving the associated leg into the workpiece;

said nosepiece including a deformation formation configured for receiving the deformation portion of the fastener upon driving engagement by said driver blade and deforming the deformation portion to provide a clamping force upon a workpiece material being secured to the workpiece, the fastener being driven into the workpiece through the momentum of the driver blade and being deformed against said deformation formation, the amount of clamping force exerted upon the workpiece material being independent of the distance the leg is driven into the workpiece by said driver blade;

wherein said nosepiece includes a front plate, a rear plate and a workpiece contact element, each of which is configured with a notch for accommodating fastener deformation.

11. The tool of claim 10 wherein said tabs are separated by a recessed portion configured for accommodating said deformation formation so that, upon engagement of said tabs with a fastener, a clearance is defined between said recessed portion and said deformation formation.

12. The tool of claim 10 wherein said deformation formation is disposed in said nosepiece to cause the deformation of said deformation portion in a direction transverse to the plane of the fastener.

13. A fastener driving tool having a reciprocating driver blade and a nosepiece, said tool being configured for sequentially feeding fasteners to said nosepiece for engagement by said driver blade for subsequent driving into a workpiece, each fastener defining a plane, said tool comprising:

a deformation formation in said nosepiece configured for engaging a portion of each of the fasteners so that upon impact of the fastener by said driver blade, the engaged fastener portion is deformed in a direction transverse to said plane to attain a deformed condition configured for providing a clamping force upon a workpiece material being secured to the workpiece;

a guide associated with said nosepiece for limiting the penetration of the fastener into the workpiece and for protecting the workpiece material from the fastener, wherein said guide is a standoff secured to a lower end of said nosepiece for defining a separation space between said nosepiece and at least one of the workpiece and the workpiece material.

* * * * *